US005918885A

United States Patent [19]

Radke, II

[11] Patent Number: 5,918,885

[45] Date of Patent: Jul. 6, 1999

[54] TUBULAR ARTICLES WITH EXTERNALLY INSTALLED ATTACHMENT CLIPS

[75] Inventor: Herman E. Radke, II, Elmwood, Tenn.

[73] Assignee: Federal-Mogul Systems Protection Group, Inc., Exton, Pa.

[21] Appl. No.: 08/814,553

[22] Filed: Mar. 11, 1997

[51] Int. Cl.[6] ..... F16J 15/02

[52] U.S. Cl. ..... 277/630; 24/458; 24/570; 248/71; 277/640; 277/637

[58] Field of Search ..... 277/630, 637, 277/640, 645, 650, 937, 943, 936; 24/458, 570, 27, 114.5; 248/71, 73; 411/913, 920, 473

[56] References Cited

U.S. PATENT DOCUMENTS

| | | | |
|---|---|---|---|
| 2,219,962 | 10/1940 | Reynolds et al. . | |
| 2,254,310 | 9/1941 | Place . | |
| 2,389,635 | 11/1945 | Place | 24/458 |
| 3,167,824 | 2/1965 | Berwanger . | |
| 3,578,764 | 5/1971 | Nunnally . | |
| 3,812,316 | 5/1974 | Milburn . | |
| 3,846,608 | 11/1974 | Valles . | |
| 4,122,323 | 10/1978 | Staats . | |
| 4,538,381 | 9/1985 | Vogel | 49/479 |
| 4,822,060 | 4/1989 | Moyer et al. | 277/166 |
| 4,986,033 | 1/1991 | Weil | 49/492 |
| 5,107,623 | 4/1992 | Weil | 49/485 |
| 5,205,075 | 4/1993 | Moyer | 49/493 |
| 5,289,658 | 3/1994 | Lusen et al. | 49/492.1 |
| 5,341,601 | 8/1994 | Moyer | 49/493.1 |
| 5,395,126 | 3/1995 | Tresslar | 277/166 |

FOREIGN PATENT DOCUMENTS

| | | | |
|---|---|---|---|
| WO 98/03822 | 1/1998 | WIPO | F24C 15/02 |

*Primary Examiner*—Anthony Knight
*Assistant Examiner*—Alison K. Pickard
*Attorney, Agent, or Firm*—Synnestvedt & Lechner LLP

[57] ABSTRACT

A tubular article useful for bundling wire or cables or for creating a seal between two surfaces, such as an oven and an oven door, is provided with externally applied attachment clips. The clips are formed from separate pieces of wire, each of which is bent at an acute angle at its mid-point to form a head portion and a pair of shoulders which fit into an aperture on one of the surfaces to be sealed. The clip further includes crossed intermediate portions followed by transversely extending base legs. The base legs are passed through the wall of the gasket and clinched so that they extend back towards the crossed portions. Gaskets are disclosed comprised of yarn, such as glass fiber yarn, interbraided with stainless steel wire. The spacing between clips may be varied to accommodate variations in aperture spacing and/or to provide tubular articles which are braided and are capable of varying in diameter at different locations along surfaces to which they are attached.

11 Claims, 2 Drawing Sheets

TUBULAR ARTICLES WITH EXTERNALLY INSTALLED ATTACHMENT CLIPS

FIELD OF THE INVENTION

This invention relates to tubular articles, such as gaskets, seals and sheaths, for harnessing wires or tubes and to the means for attachment of the articles to a surface. One particular application relates to the attachment of gaskets to one surface which is relatively movable toward and away from a second surface. The tubular articles of this invention are especially comprised of a thermally insulating yarn which may be supported by an inner tubular wire bulb or may itself be interbraided with wire. In a particular application, the articles are gaskets used, for example, as oven door seals.

BACKGROUND OF THE INVENTION

Woven tubular articles have been used for seals for oven doors for many years. These articles are typically made from a combination of an inner tubular support member formed of knitted wire and an outer tubular member made either by braiding, knitting or weaving an insulating material such as glass fiber yarn. Such structures have proven to be durable at the high temperatures used in self-cleaning ovens and provide a good seal despite repeated openings and closures of the oven door over many years of use. Usually, an inner tubular member of resilient wire, sometimes called a bulb, provides the necessary resilient support for the glass fiber tubular gasket. Various methods of attaching a tubular gasket to an oven or oven door surface have typically comprised providing a retaining member which extends along the gasket and locking the retaining member between sheet metal pieces of the oven door or by providing clamps at spaced locations around the periphery of the gasket. Examples of such oven gaskets and their attachment are shown in U.S. Pat. No. 2,219,962 to Reynolds et al; 3,578,764 to Nunnally et al; 3,812,316 to Milburn; 3,846,608 to Valles; and 4,122,323 to Stats.

An alternative form of gasket having attachment means comprised of a wireform having spaced attachment protrusions which fit into corresponding apertures in a surface to which the gasket is to be attached is shown in U.S. Pat. Nos. 4,822,060 and 5,395,126. In the '126 patent, the interior support core is eliminated. Wire interbraided with glass fiber forms a resilient support matrix which also locks the protrusions in place.

Although tubular articles of the above kind are effective for their intended purpose, fabrication requires a relatively high level of skill. A problem may arise in the production of gaskets of the '060 patent owing to the difficulty of insertion of the wireform carrying the protrusions through the knitted tubular wire bulb and then in the passage of the protrusions through the bulb and the overlayer of braided gasket material. Not only does the insertion of the wireform tend to be a difficult task to accomplish, the use of the wire form imposes a limit on the minimum gasket diameter. In addition, the passage of the protrusions through the exterior gasket layer may tear the individual strands of glass fiber if not carefully done, resulting in a potentially undesirable scrap rate. Further, because the surfaces to which the tubular articles are to be attached have attachment aperture locations at different spacings for different products, a range of wireforms having different spacings for the attachment protrusions must be provided.

Still another form of attachment means comprises individual clips as disclosed, for example, in U.S. Pat. Nos. 4,986,033, 5,107,623 and 5,205,075. The '075 patent discloses a clip having an apex and a pair of pointed ends which are bent laterally so as to project between an interknitted bulb and an outer gasket layer. The interknitted bulb is effective to maintain the clips in an upright position so that the pointed ends extend outwardly from the gasket in a radial direction in order to facilitate insertion into the apertures formed in one of the oven surfaces.

Clips of the type shown in the '075 patent are inserted from the interior of the tubular article and passed through its periphery and may be inserted at variable spacing. However, clip insertion requires an anvil to be inserted within the tubular article, and the attachment of clips is difficult in small diameter articles.

SUMMARY OF THE INVENTION

According to the invention, a tubular article is provided which, in a first preferred embodiment, is comprised of glass fiber yarn or yarn of other suitable thermally insulating fiber and a flexible and resilient support wire. Attachment clips are provided which are externally fastened to the side wall of the tubular article without the need for an interior anvil, thereby simplifying attachment of the clips, allowing for the use of tubular articles of smaller diameter and simplifying attachment of additional clips as may become necessary at the site of attachment of the article to a surface, such as one of pair of surfaces, comprising a joint to be sealed. Preferably, when intended for use as oven gaskets, the tubular articles are formed of woven, braided or knitted glass fiber yarn, although yarns of other insulating materials may be employed. Resilience is imparted to the articles by a support layer of resilient wire which also may be interlaced as by weaving, braiding or knitting. In certain preferred embodiments of the invention, the wire and the insulating yarn are interlaced into a tubular article having a composite layer comprised of the yarn and resilient wire. In preferred forms of tubular articles where the wire and yarn are braided together, the product is extremely flexible and fits around sharp corners on surfaces to which it is applied without kinking. In a gasket application, the gasket of the invention is readily compressible due to the resilient nature of the wire when the two surfaces between which a seal is to be established are brought together and readily returned to its original shape once the surfaces are separated over a life span that may include thousands of compression cycles.

In applications where the tubular articles serve the purpose of harnessing cables or tubes, the articles may be woven, braided or knitted from resilient engineered plastic monofilament materials without the incorporation of interwoven resilient wires.

According to the invention, individual wire clips are formed from separate wire sections of a relatively resilient wire which can be preformed with relatively simple tools to form attachment clips. The form of clip utilized in the invention comprises a generally pointed head portion formed by bending the wire section at about its mid-point, has diverging shoulder portions sloping away from the point of the head and crossing intermediate sections all lying substantially in a common plane. The intermediate sections are followed by base leg sections which are bent to point laterally with respect to the plane of the head and the crossing intermediate sections.

In providing a tubular article with attachment clips of the kind mentioned, a preferred tubular article is preferably braided from a combination of insulating yarn and resilient wire. The side wall of the tubular article is pinched together at a selected location for clip attachment, and the pointed end sections of a clip are passed through the pinched gasket wall just adjacent the edge of the bend. Following insertion of the pointed end sections of the clip, the projecting ends are next bent back towards the crossing intermediate portions, thereby locking the clip in place. Following attachment, the resilient tubular article is released so that it returns to a substantially cylindrical form. The process is repeated at the next location where a clip is required and continued until all locations requiring a clip have clips attached.

An advantage of the invention is that the need for an anvil or other clip attaching device fitting inside the tubular article is eliminated. The clips can be attached at the site of attachment of the article to a surface with simple, relatively available tools, shortening installation time where clips have become separated from the articles or damaged during handling or where a particular product requires clips at additional fastening locations. Replacement of gaskets on older model oven doors is facilitated. Variable spacing of clips along a tubular article is readily and simply accomplished with the above-described invention.

DETAILED DESCRIPTION OF PREFERRED EMBODIMENTS OF THE INVENTION

Figure 1:
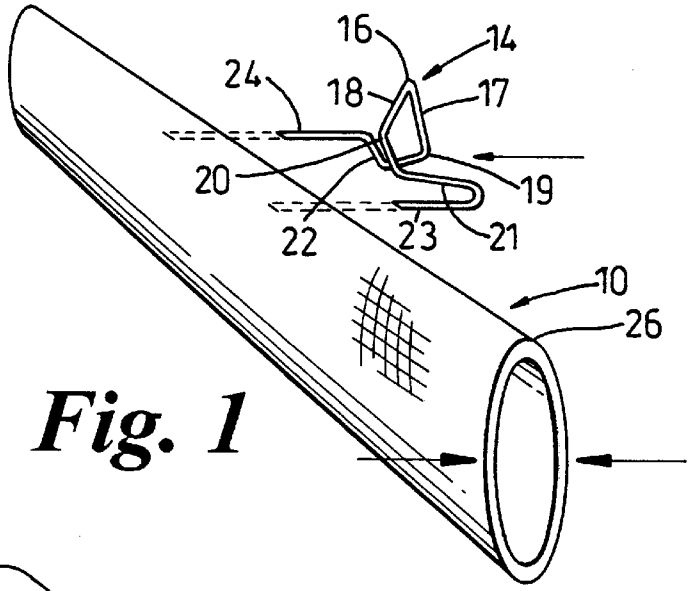
FIG. 1 illustrates a tubular article having a wall portion compressed with a clip formed according to the invention at the point of insertion through its periphery.
Figure 2:
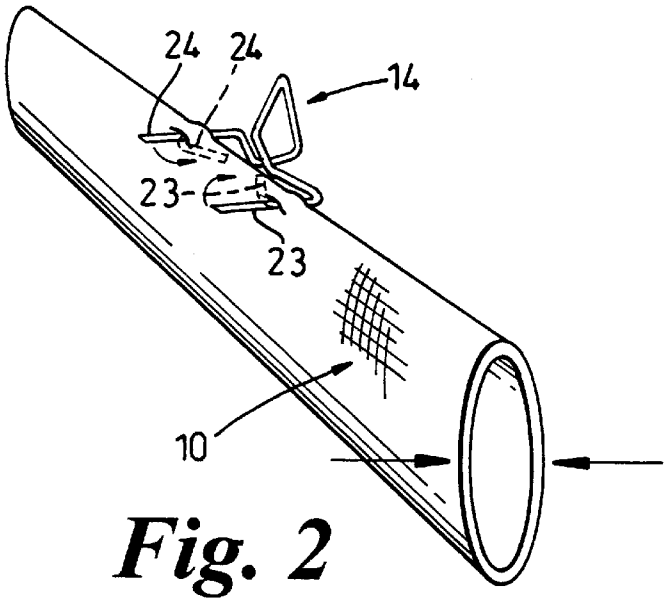
FIG. 2 is a view similar to FIG. 1 showing the clip inserted with the end portions of the clip being illustrated in broken line form.

With reference first to FIGS. 1–4 in which a preferred embodiment is disclosed, a tubular article 10 intended to serve as an oven gasket, formed preferably by braiding, is fabricated on a circular braider utilizing ends of an insulating yarn such as spun glass fiber or yarns of ceramic, quartz or related materials and mixtures thereof, the yarns being characterized by low thermal conductivity. The yarn is preferably interbraided with a resilient wire formed of stainless steel, although other materials may be employed. Preferably, the wire is full, hard stainless steel wire of a diameter of about 9 mils in a typical household type oven door application. Other metallic wires may be employed so long as they are relatively flexible and resilient so as to allow for repeated compression and have the capacity to repeatedly return to original shape over a life span which comprises thousands of cycles.

For certain applications, a separate wire bulb, preferably knitted, may be inserted within the braided layer so as to provide the requisite resilience.

In the preferred embodiments of carrying out the invention, the wire and glass fiber yarn are interbraided on a circular braider, as illustrated, for example, in U.S. Pat. No. 5,395,126, 5,395,127 incorporated herein by reference. As explained in that patent, the yarn and wire are loaded on separate carriers on the braider. A preferred braided structure is formed using 24 carriers of wire and 48 carriers of glass fiber yarn in a 72 carrier circular braider. Variations of the proportions of wire and yarn may be employed. A preferred range is from about 25% wire to about 75% yarn up to about 50% wire and 50% yarn. Preferably, the yarn employed is a continuous multifilament E glass, such as type E373 supplied by the Owens Corning Fiberglas Company. Stainless steel wire of 9 mils diameter is employed, although the diameter of wire may vary in range from about 3 mils to about 15 mils in the production of gaskets for the doors of self cleaning ovens.

Clips 14 used for the attachment of the tubular article to an apertured surface, as for example, a surface adjacent to the perimeter of an oven door, are individually formed of separate lengths of formable wire, such as stainless steel, having a relatively high flexural modulus. Each clip is formed by bending the wire at about its mid-point to form a generally pointed head portion 16 which includes relatively outwardly sloping sections 17 and 18. The wire is bent again at 19 and 20 to form a pair of shoulders followed by crossing intermediate sections 21 and 22. The head and shoulder portions and the crossing intermediate portions all lie generally in the same plane. The ends of the crossing intermediate sections are bent to project laterally, as shown at 23 and 24 to form transversely extending base portions.

Attachment at selected locations on the tubular article is accomplished by selective compression of the article side wall along a selected edge portion 26. Following compression at the selected location, the clip end portions 23 and 24 are passed through the pinched together side wall portions of the article immediately adjacent edge 26, as can be seen by inspection of FIGS. 1 and 2. Following insertion of the end portions of the clip, the projecting ends are bent inwardly back towards the crossing intermediate sections utilizing pliers or suitable bending equipment.

Figure 3:
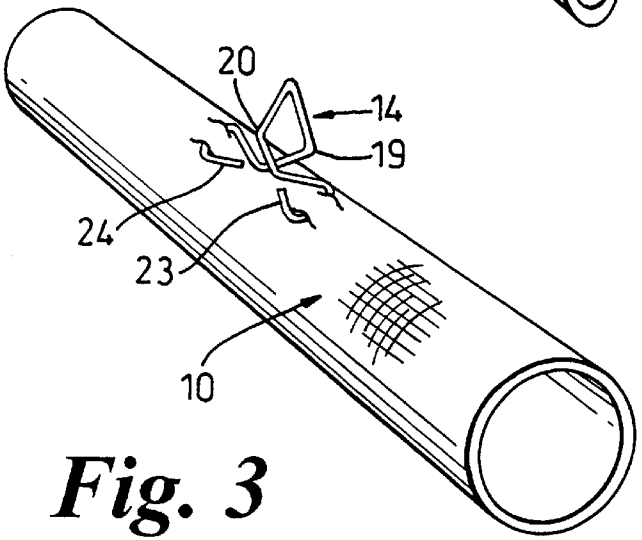
FIG. 3 is a view of a gasket following attachment of a clip and the resilient wall portion released.

FIG. 3 illustrates the tubular article following attachment of a clip after the resilient wall portion has been released to allow it to return to its original, substantially cylindrical shape.

Figure 4:
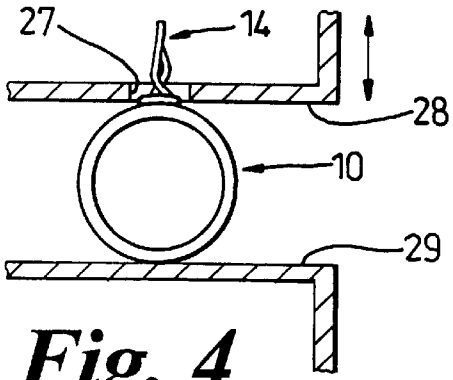
FIG. 4 is an end view of FIG. 3.

FIG. 4 illustrates the tubular article of FIG. 3 showing the clip projecting radially with respect to the article through an aperture 27 in a first surface 28 spaced from a second surface 29.

Following attachment of each clip, the installer progresses to the next clip location and repeats the process until all clips have been attached. In placement of the clips, a uniform interval between clips will ordinarily be employed, although variable spacing may sometimes be desirable.

Figure 5:
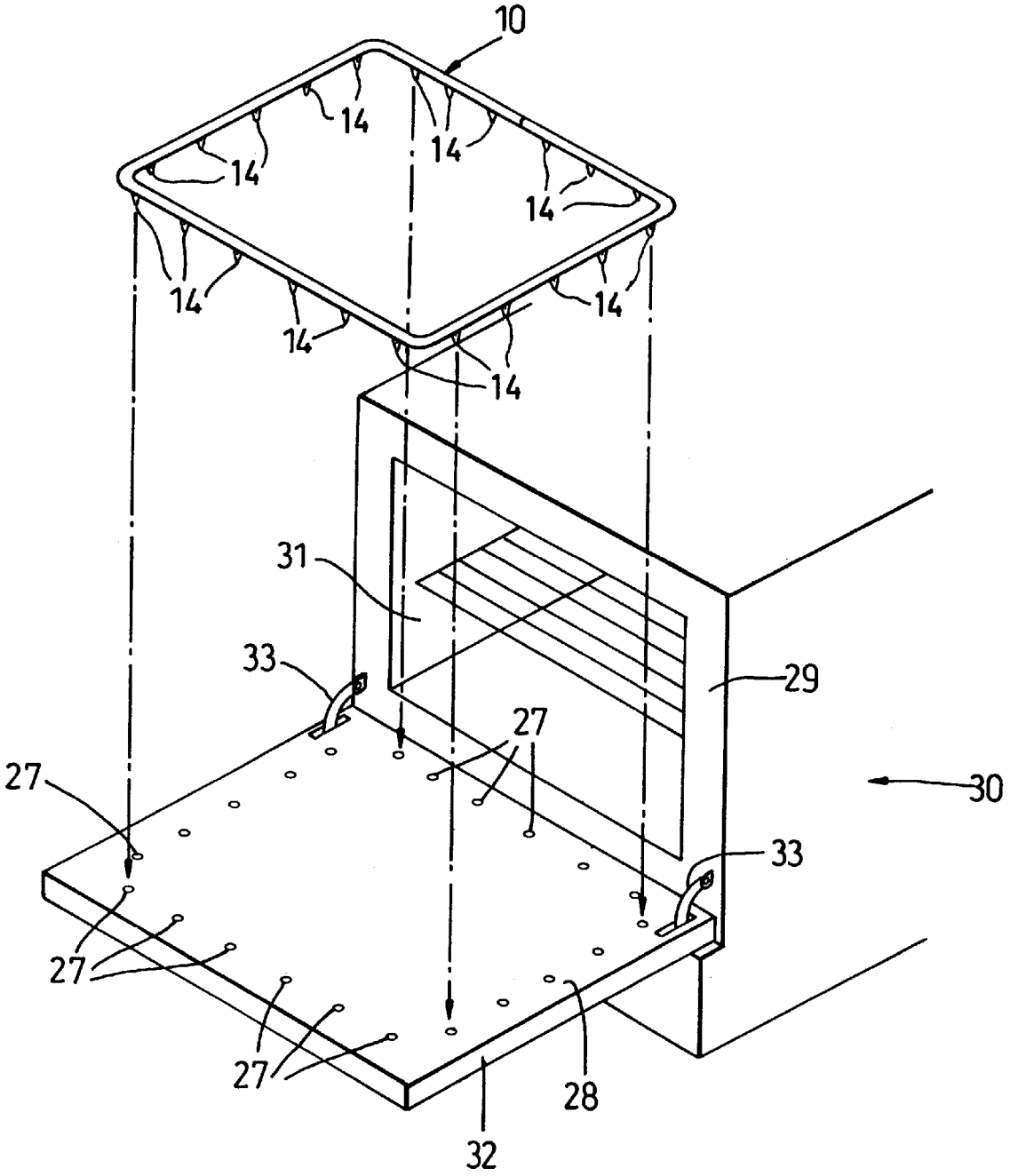
FIG. 5 is an exploded assembly view, in perspective, showing the installation of a gasket equipped with clips of the kind shown in FIGS. 1–4.

In FIG. 5, an oven 30 in which an oven chamber 31 is located is provided with a door 32 hingedly attached to the oven by hinges 33. Door surface 28 is provided with apertures 27 within which the heads of clips 14 are attached. When attached, the tubular article serves as a gasket which bears against surface 29 when the oven door is closed.

As compared with clips comprised of projections extending from a single wire form, the invention facilitates variable spacing. This allows for forming gaskets in which the gasket diameter is selectively varied when a braided gasket structure allowing for radial expansion when the gasket is axially compressed is employed.

In another embodiment of the invention, the tubular article 10, as illustrated in FIG. 1, may be a textile sleeve of the kind used for shielding and protection of bundles of elongated articles, such as wires, cables or tubes. Preferably, the sleeve is braided in an open braid so as to allow for radial expansion over parts, such as cable connectors or tube flanges. Although tubular sleeves incorporating the principles of the invention may sometimes be fabricated without the use of resilient wire components, the wire components are of advantage in maintaining the shape of the sleeve and providing a strong and reliable structure to which clips can be anchored.

Other advantages of the invention are that the invention permits the fabrication of gaskets and other tubular articles small enough in diameter that a continuous wire form or a clip installed from inside the gasket would be impractical. Still further, tubular articles formed according to the invention allow for the custom placement of attachment clips at the site of installation of the articles and facilitate the replacement of articles where attachment apertures on a sealing surface are not at standard spacings.

I claim:

1. An article having a tubular shape and having attachment means for attaching said article to a support surface having attachment apertures spaced at predetermined intervals, said article comprising:

a tubular sleeve having a periphery of curved cross-sections; and a plurality of resilient attachment clips spaced lengthwise of the tubular sleeve at intervals corresponding to said predetermined intervals for attachment of the article to the apertures in said surface, each said clip comprising a separate discrete length of wire preformed to include a centrally located head portion, a pair of shoulders joined to the head portion and crossed portions all lying substantially in a common plane, said crossed portions being followed by base portions first extending transversely of the common plane of the head and said crossed portions, said base portions extending in a common direction to transect the curved cross-section of said tubular sleeve at spaced apart locations in planes extended transversely thereof, said base portions being terminated in end portions extending from the curved cross-section and being bent back towards the crossed portions.

2. An article according to claim 1, wherein said tubular sleeve is comprised of a thermally resistant yarn.

3. An article according to claim 2, wherein said thermally resistant yarn is a glass fiber yarn.

4. An article according to claim 3, wherein said glass fiber yarn is braided.

5. An article according to claim 1, wherein said attachment clips are formed of stainless steel wire.

6. An article of tubular form for sealing a space between first and second surfaces, wherein one of said surfaces has a plurality of spaced attachment apertures, said tubular article comprising:

(a) interwoven yarns of an insulating material, said material selected from the group consisting of ceramic, quartz and glass fibers and mixtures thereof; and (b) a plurality of individual wire clips for securing the tubular article to the apertures, each said wire clip comprising a single discrete length of resilient, formable wire, each said discrete length having a centrally located preformed bend, a pair of sloping sections inclining away from said preformed bend, said sloping sections terminating in a pair of second preformed bends, said wire extending from said second preformed bends in a pair of crossing sections, said sloping sections and said crossing sections lying substantially in a first common plane, said wire further including base sections in a plane extended transversely of said first common plane, said base sections each terminating in an end portion projecting through said article at adjacent spaced apart locations, said end portions extending outwardly of the article in the same direction and being bent to extend lengthwise thereof.

7. An article according to claim 6, wherein said end portions extend through the periphery of said article in planes extending transversely of the article.

8. An article according to claim 7, wherein said end portions terminate in sections bent towards the intermediate crossed portions.

9. An article according to claim 8, wherein said article is knitted.

10. An article according to claim 9, further wherein said article is knitted from a combination of glass fiber yarns and wire.

11. A method of making a tubular article for sealing a space between two surfaces wherein one of said surfaces is provided with a series of attachment apertures spaced at predetermined intervals, said method comprising:

interlacing yarns to form a tubular resilient sealing member;

providing attachment clips, each comprising a separate discrete length of wire preformed to include a centrally located head portion, a pair of shoulders spaced from the head portion, crossed intermediate sections all lying substantially in a common plane and a pair of base sections extending from said crossed intermediate sections in substantially parallel relationship to each other and in a plane extending transversely of said crossed intermediate sections;

pinching the sealing member at spaced intervals corresponding to the intervals between said attachment apertures to bring adjacent portions of the sealing member into close side-by-side relationship; and attaching the clips to the tubular article by passing said base sections through said adjacent portions and bending the ends of said base sections relatively inwardly towards said crossed intermediate sections to secure the clip in fixed relationship relative to said tubular article.

* * * * *